US008487722B2

(12) United States Patent
Mills et al.

(10) Patent No.: US 8,487,722 B2
(45) Date of Patent: Jul. 16, 2013

(54) THERMALLY MANAGED ELECTROMAGNETIC SWITCHING DEVICE

(75) Inventors: Patrick W. Mills, Bradenton, FL (US); James M. McCormick, Bradenton, FL (US); Kevin F. Hanley, Bradenton, FL (US); Timothy R. Budd, Bradenton, FL (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 13/579,410

(22) PCT Filed: Jul. 15, 2010

(86) PCT No.: PCT/US2010/042114

§ 371 (c)(1),
(2), (4) Date: Aug. 16, 2012

(87) PCT Pub. No.: WO2011/109036

PCT Pub. Date: Sep. 9, 2011

(65) Prior Publication Data

US 2012/0319806 A1 Dec. 20, 2012

Related U.S. Application Data

(60) Provisional application No. 61/310,542, filed on Mar. 4, 2010.

(51) Int. Cl.
*H01H 5/00* (2006.01)

(52) U.S. Cl.
USPC ..... 335/185; 335/131

(58) Field of Classification Search
USPC ..... 335/185
See application file for complete search history.

(56) References Cited

U.S. PATENT DOCUMENTS

| | | | | |
|---|---|---|---|---|
| 3,099,730 | A * | 7/1963 | Tateishi | 335/131 |
| 3,339,161 | A * | 8/1967 | Conner et al. | 335/131 |
| 3,388,353 | A * | 6/1968 | Isler | 335/132 |
| 3,544,929 | A * | 12/1970 | Kussy et al. | 335/126 |
| 3,560,901 | A * | 2/1971 | Horii et al. | 335/132 |
| 3,942,144 | A * | 3/1976 | Contal | 335/132 |

(Continued)

FOREIGN PATENT DOCUMENTS

EP 2 001 032 A1 12/2008

OTHER PUBLICATIONS

Miller, J., "Thermally conductive polymers delete the heat", MachineDesign.com, http://machinedesign.com/article/thermally-conductive-polymers-delete-the-heat-0503, May 3, 2001, 3 pp.

(Continued)

*Primary Examiner* — Elvin G Enad
*Assistant Examiner* — Lisa Homza
(74) *Attorney, Agent, or Firm* — Eckert Seamans Cherin & Mellott, LLC; Kirk D. Houser

(57) ABSTRACT

A thermally managed electromagnetic switching device (2) is provided that includes a current carrying component set (4) switchable between a closed, current carrying state and an open, current interrupting state. A thermally dissipating component set (6) functionally supports and electrically isolates the current carrying component set (4) in the open state. The thermally dissipating component set (6) includes at least in part a thermally conductive polymer and is cooperatively configured to transfer heat away from the current carrying component set (4) in the closed state to dissipate thermal energy.

15 Claims, 10 Drawing Sheets

U.S. PATENT DOCUMENTS

| | | | | |
|---|---|---|---|---|
| 3,964,006 | A * | 6/1976 | Lacan | 335/132 |
| 4,893,102 | A * | 1/1990 | Bauer | 335/132 |
| 5,315,471 | A * | 5/1994 | Hurley et al. | 361/160 |
| 5,488,340 | A * | 1/1996 | Maley et al. | 335/253 |
| 5,605,289 | A * | 2/1997 | Maley et al. | 239/585.1 |
| 5,680,083 | A * | 10/1997 | Kogawa et al. | 335/132 |
| 5,886,601 | A * | 3/1999 | Kitamura et al. | 335/129 |
| 5,920,251 | A | 7/1999 | Shea | |
| 5,953,197 | A * | 9/1999 | Driendl | 361/191 |
| 6,064,289 | A * | 5/2000 | Wieloch et al. | 335/132 |
| 6,194,984 | B1 * | 2/2001 | Kappel et al. | 335/132 |
| 6,377,143 | B1 * | 4/2002 | Zhou et al. | 335/132 |
| 6,549,108 | B2 * | 4/2003 | Fausch | 335/129 |
| 6,567,250 | B1 * | 5/2003 | Haun et al. | 361/42 |
| 6,911,884 | B2 * | 6/2005 | Uotome et al. | 335/132 |
| 6,967,549 | B2 * | 11/2005 | Zhou et al. | 335/106 |
| 7,701,314 | B2 * | 4/2010 | Hazzard et al. | 335/278 |
| 2004/0048054 | A1 * | 3/2004 | Tobita et al. | 428/219 |
| 2008/0289943 | A1 | 11/2008 | Kakisako et al. | |
| 2010/0026427 | A1 * | 2/2010 | Moeller et al. | 335/71 |
| 2011/0056197 | A1 * | 3/2011 | Schmidt et al. | 60/527 |
| 2011/0114602 | A1 * | 5/2011 | Bush et al. | 218/156 |

OTHER PUBLICATIONS

United States Patent and Trademark Office, "International Search Report and Written Opinion", Sep. 14, 2010, 11 pp.

* cited by examiner

THERMALLY MANAGED ELECTROMAGNETIC SWITCHING DEVICE

CROSS REFERENCE TO RELATED APPLICATION

This application claims the benefit of U.S. Provisional Patent Application Ser. No. 61/310,542, filed Mar. 4, 2010, which is incorporated by reference herein.

BACKGROUND

1. Field

The disclosed concept pertains generally to electrical switching apparatus and, more particularly, to electromagnetic switching devices, such as, for example, relays and contactors.

2. Background Information

Electromagnetic switching devices are often used to electrically couple a power source to a load such as, for example and without limitation, an electrical motor or other suitable load. An electromagnetic switching device can include both fixed and movable electrical contacts as well as an electromagnetic coil. Upon energization of the electromagnetic coil, a movable contact engages a number of fixed contacts so as to electrically couple the power source to the load. When the electromagnetic coil is de-energized, the movable contact disengages from the number of fixed contacts thereby disconnecting the load from the power source.

In aircraft applications, for instance, electromagnetic switching devices account for a significant portion of the heat generated in aircraft electrical systems and, therefore, may greatly benefit from improved thermal management. For example, for a total voltage drop of 0.175 V for two contact points and a load current of 400 A, the total heat generation is 70 W or 35 W per contact point. The electromagnetic coil is also a source of heat generation. For example, for a voltage drop of 28 V and a holding current of 0.2 A, the total heat generation is 5.6 W.

There is room for improvement in electrical switching apparatus, such as electromagnetic switching devices.

SUMMARY

These needs and others are met by embodiments of the disclosed concept, which employ a thermally dissipating component set to functionally support and electrically isolate a current carrying component set in an open state. The thermally dissipating component set comprises a thermally conductive polymer and is cooperatively structured to transfer heat away from the current carrying component set in the closed state to dissipate thermal energy.

In accordance with one aspect of the disclosed concept, a thermally managed electromagnetic switching device comprises: a current carrying component set switchable between a closed, current carrying state and an open, current interrupting state; and a thermally dissipating component set that functionally supports and electrically isolates the current carrying component set in the open state, the thermally dissipating component set comprising a thermally conductive polymer and being cooperatively structured to transfer heat away from the current carrying component set in the closed state to dissipate thermal energy.

As another aspect of the disclosed concept, a thermally managed electromagnetic switching device comprises: a current carrying component set switchable between a closed, current carrying state and an open, current interrupting state; an operating mechanism structured to move the current carrying component set between the closed, current carrying state and the open, current interrupting state; and a thermally dissipating component set that functionally supports and electrically isolates the current carrying component set in the open state, the thermally dissipating component set comprising a thermally conductive polymer and being cooperatively structured to transfer heat away from the current carrying component set in the closed state to dissipate thermal energy.

As another aspect of the disclosed concept, a thermally managed electromagnetic switching device comprises: a current carrying component set switchable between a closed, current carrying state and an open, current interrupting state; an electromagnetic actuator; a thermally dissipating component set that functionally supports and electrically isolates the current carrying component set in the open state, the thermally dissipating component set comprising a thermally conductive polymer and being cooperatively structured to transfer heat away from the current carrying component set in the closed state to dissipate thermal energy; a switch housing; a number of auxiliary switches; and a number of rocker arms actuated by the electromagnetic actuator, wherein the number of auxiliary switches is actuated by the electromagnetic actuator through the number of rocker arms.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
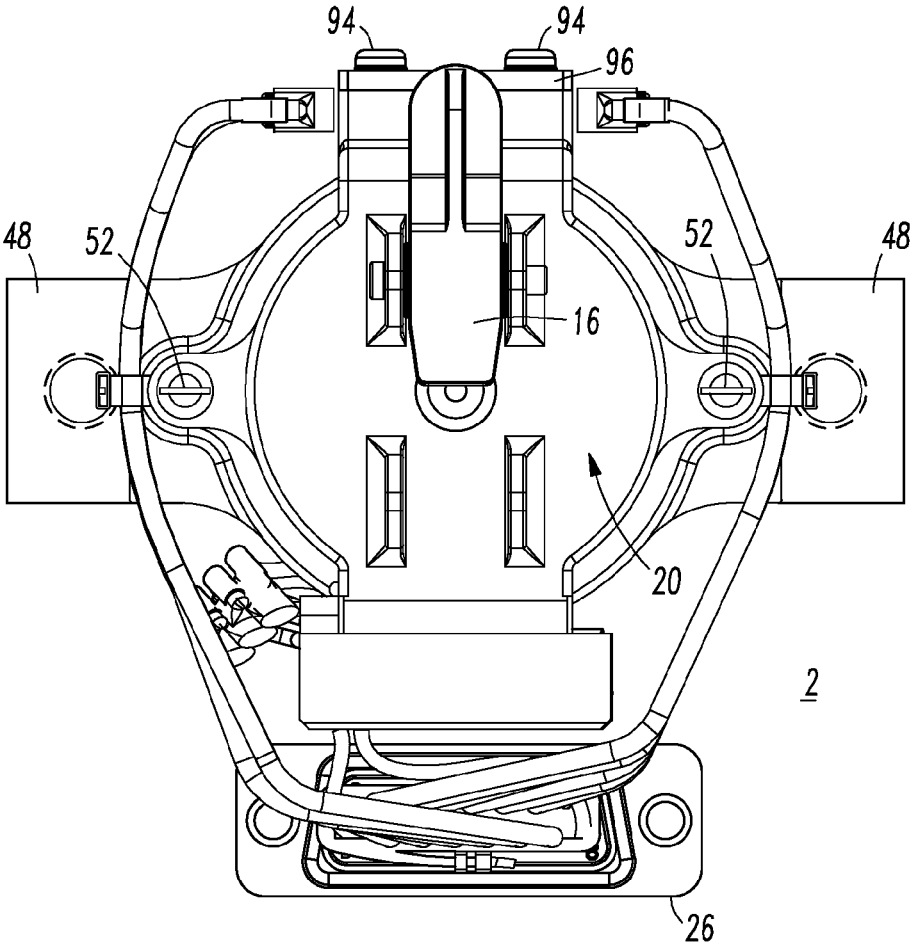
FIG. 1 is a top plan view of a relay in accordance with embodiments of the disclosed concept.

As employed herein, the term "number" shall mean one or an integer greater than one (i.e., a plurality).

As employed herein, the term "electrical conductor" shall mean a wire (e.g., solid; stranded; insulated; non-insulated), a copper conductor, an aluminum conductor, a suitable metal conductor, or other suitable material or object that permits an electric current to flow easily.

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

As employed herein, the term "managed" shall mean handled or directed with a degree of skill, worked upon or tried to alter for a purpose, or succeeded in accomplishing or achieved a purpose.

Referring now to the drawings, which are not intended to limit the disclosed concept, FIGS. 1-13 illustrate and describe an electromagnetic switching device 2 (e.g., without limitation, relay; contactor) according to a non-limiting embodiment of the disclosed concept that is suitable for use in an aircraft electrical system. It will be appreciated, however, that the disclosed concept is applicable to a wide range of electromagnetic switching devices for a wide range of applications.

Figure 4:
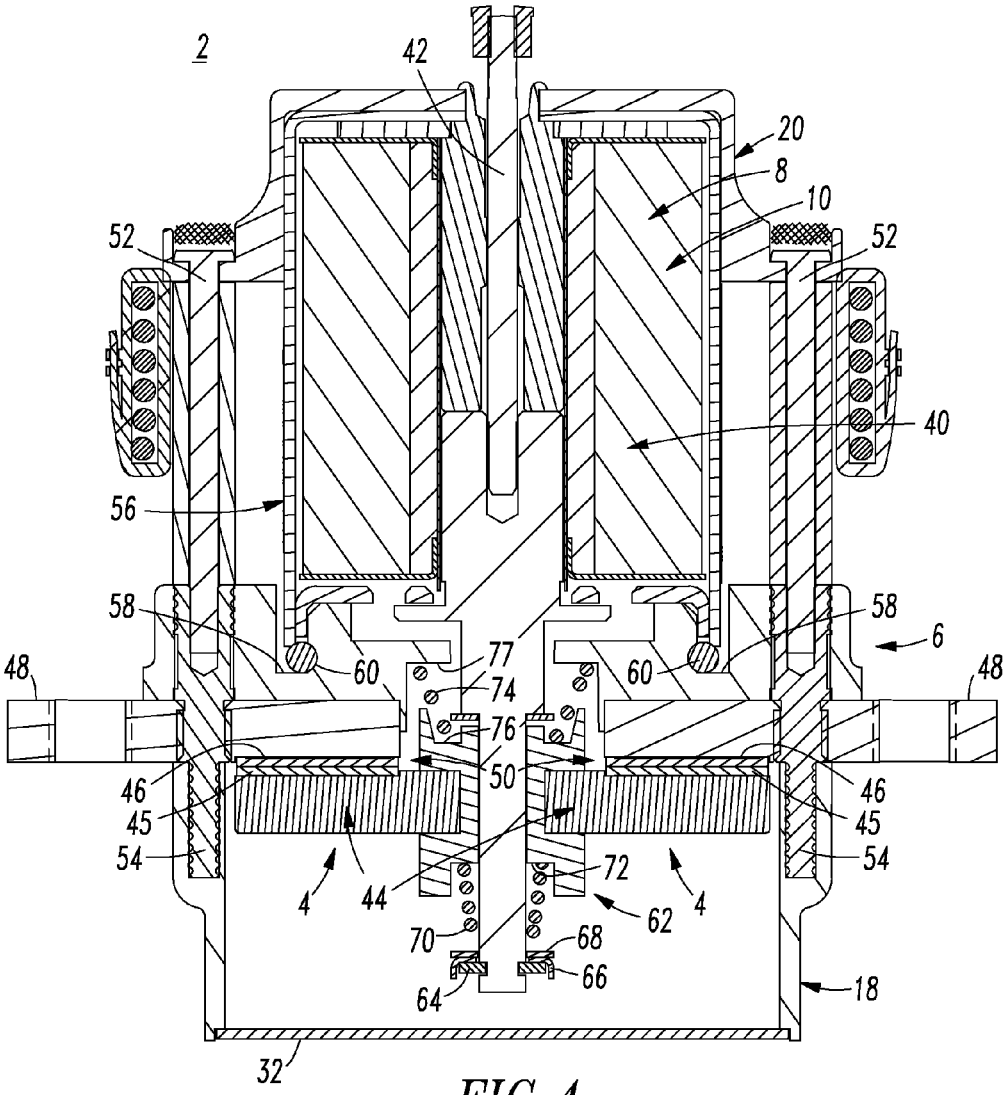
FIGS. 4 and 5 are cross sectional views of the relay of FIG. 3 in the closed position.
Figure 5:
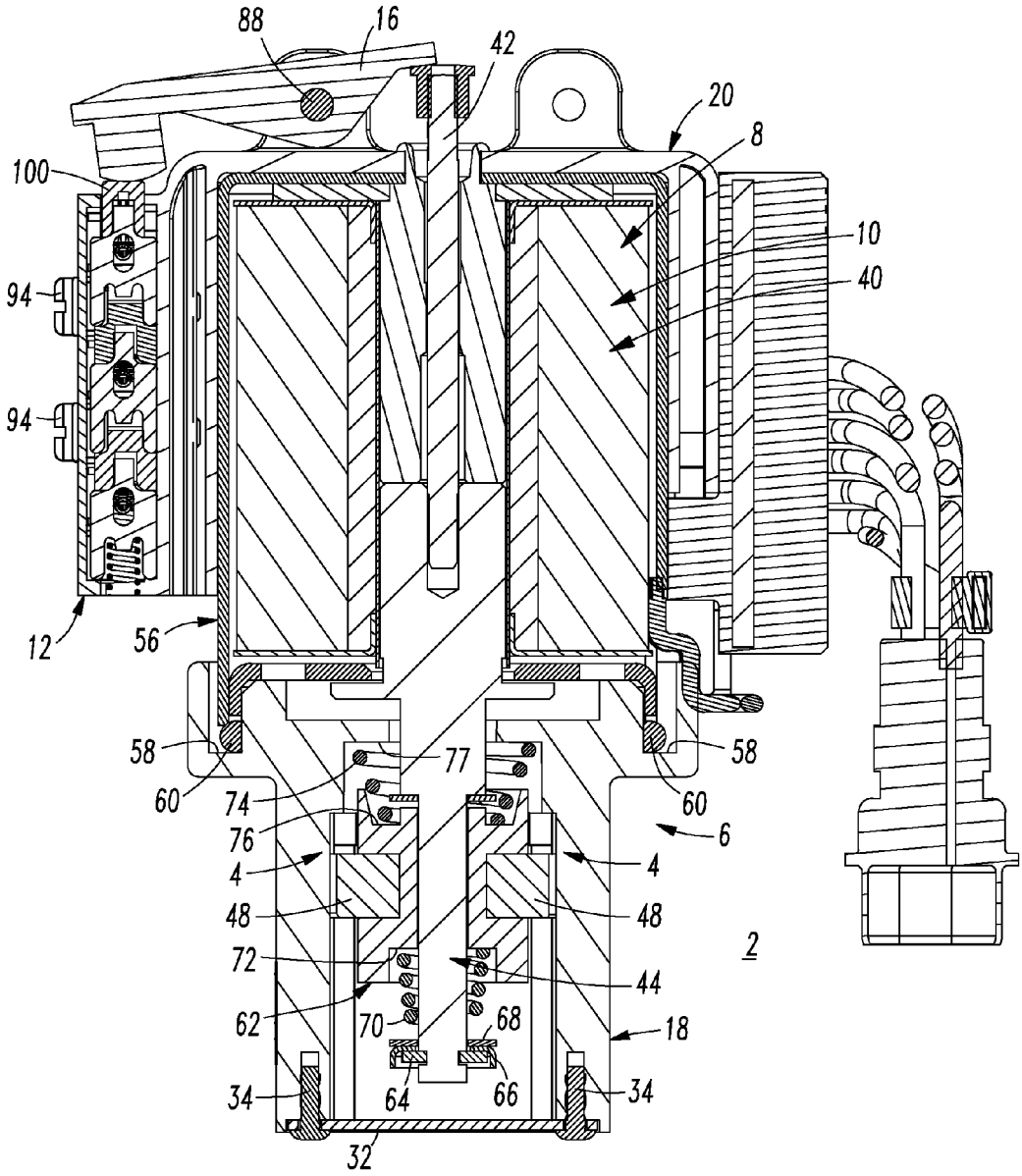
Figure 6:
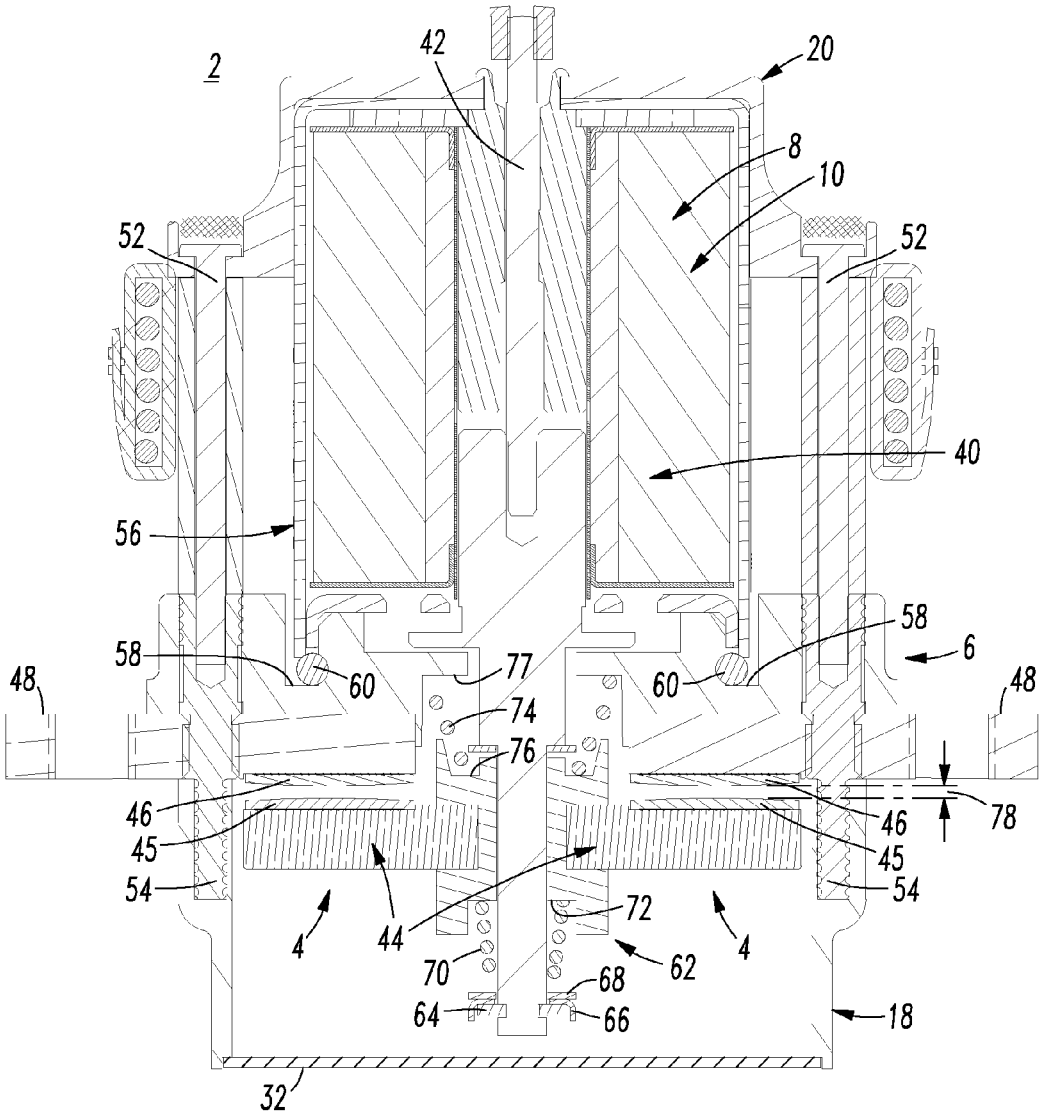
FIGS. 6 and 7 are cross sectional views of the relay of FIG. 3 in the open position.
Figure 7:
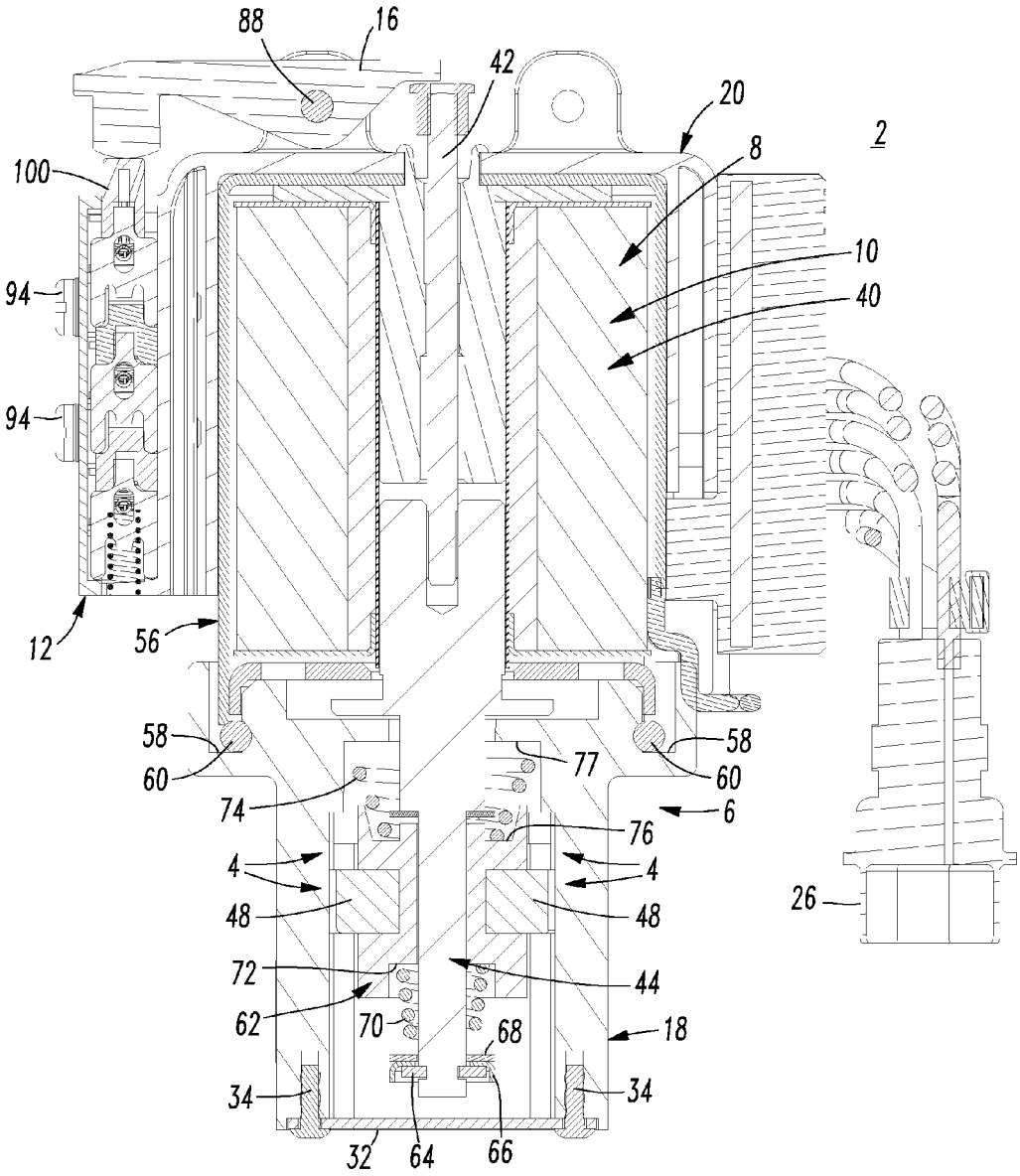

The example thermally managed electromagnetic switching device 2 includes a current carrying component set 4 (FIGS. 4-7) switchable between a closed, current carrying state (as shown in FIGS. 4 and 5) and an open, current interrupting state (as shown in FIGS. 6 and 7). A thermally dissipating component set 6 (FIGS. 4-11) functionally supports and electrically isolates the current carrying component set 4 in the open state. As will be described, the thermally dissipating component set 6 includes a thermally conductive polymer and is cooperatively structured to transfer heat away from the current carrying component set 4 in the closed state to dissipate thermal energy over a relatively greater surface area away from the current carrying component set 4, and to another area of the electromagnetic switching device 2.

An operating mechanism 8 (FIGS. 4-7) is structured to move the current carrying component 4 set between the closed, current carrying state (FIGS. 4 and 5) and the open, current interrupting state (FIGS. 6 and 7). The operating mechanism 8 includes an electromagnetic actuator 10.

The example thermally managed electromagnetic switching device 2 can also include a switch housing 12 (FIG. 3), a number of auxiliary switches 14 (FIG. 13), and a number of rocker arms 16 actuated by the electromagnetic actuator 10. As will be discussed in connection with FIG. 13, the number of auxiliary switches 14 are actuated by the electromagnetic actuator 10 through the number of rocker arms 16.

Figure 2:
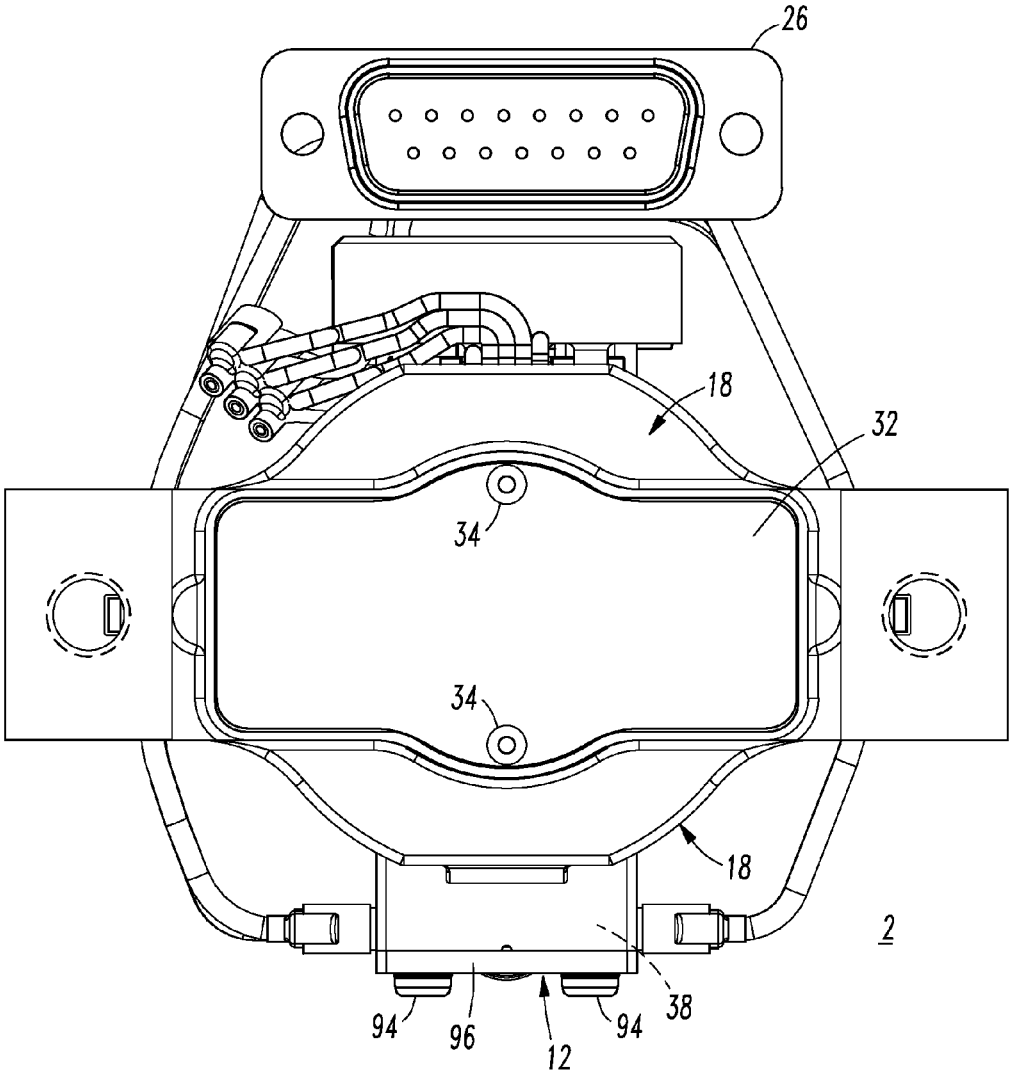
FIG. 2 is a bottom plan view of the relay of FIG. 1.
Figure 3:
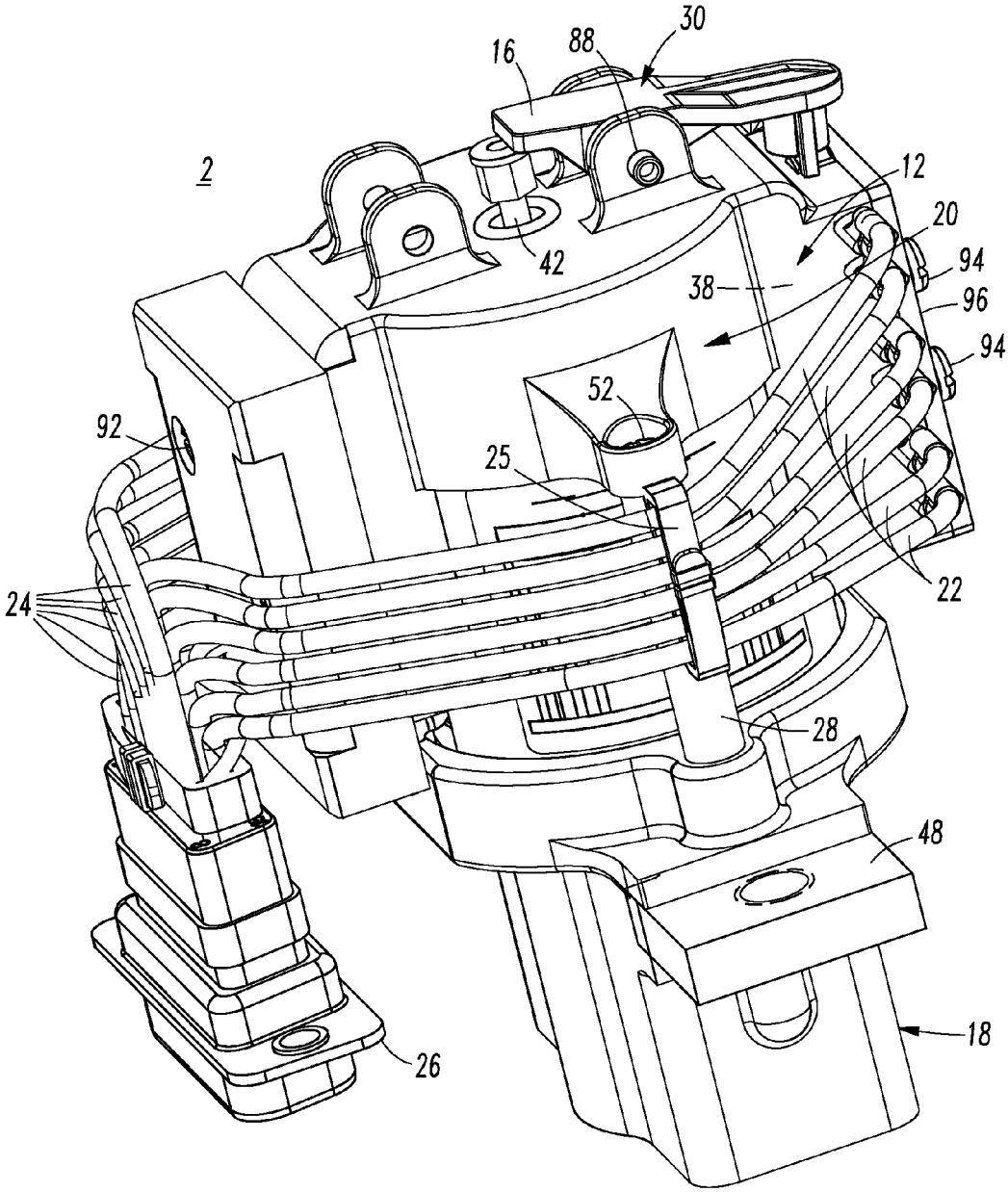
FIG. 3 is an isometric view of the relay of FIG. 1.

Referring to FIG. 3, the example thermally managed electromagnetic switching device 2 includes a base 18, a cover 20, a plurality of lead wires 22,24 secured by a cable tie 25, a pin connector 26, an insulator sleeve 28, and a mount/basic switch assembly 30. As shown in FIG. 2, a cover 32 is secured to the base 18 by drive screws 34. The example thermally managed electromagnetic switching device 2 can further include the switch housing 12 configured with double break auxiliary switches 38 (shown in hidden line drawing in FIG. 3) that are actuated by the electromagnetic actuator 10 (e.g., including a coil 40 and a plunger 42 as shown in FIG. 4) through a number of rocker arms 16.

FIGS. 4 and 5 show the thermally managed electromagnetic switching device 2 in its closed position, and FIGS. 6 and 7 show the device 2 in its open position. The electromagnetic coil 40 induces movement of the plunger 42 in the presence of an electric current flowing through the coil 40, and the plunger 42 moves upward (with respect to FIGS. 4 and 5) and actuates (FIG. 5) the example rocker arm 16 in the closed state. This causes the number of auxiliary switches 14 (FIG. 13) to follow the state of the device 2.

The current carrying component set 4 includes a movable contact member 44 fixedly coupled to the plunger 42 for movement therewith, and a pair of electrically conductive fixed contacts 46 carried by bus bars 48. Each electrically conductive fixed contact 46 is electrically isolated from the other fixed contact 46 when the current carrying component set 4 is in the open state (FIGS. 6 and 7), and is electrically connected in the closed state (FIGS. 4 and 5) by movement of the movable contact member 44 carrying a pair of movable contacts 45 into contact with the pair of electrically conductive fixed contacts 46.

The thermally dissipating component set 6 includes the base 18 within which the pair of electrically conductive fixed contacts 46 is coupled and the two covers 20,32 coupled to the base 18. The movable contact member 44 and the pair of electrically conductive fixed contacts 46 define an interface 50 (FIG. 4) therebetween in the closed state (FIGS. 4 and 5). The base 18 and the cover 32 enclose the movable contact member 44, the electrically conductive movable contacts 45, the interface 50 and the electrically conductive fixed contacts 46. The electrically conductive fixed contacts 46 are mechanically interlocked or chemically bonded to the base 18, as will be described.

The cover 20 is coupled to the base 18 by two fasteners, such as screws 52, which engage two threaded inserts 54 of the base 18. The cover 20 covers a coil shell assembly 56 of the electromagnetic actuator 10. The coil shell assembly 56 rests in an annular groove 58 of the base 18 on an O-ring 60.

The movable contact member 44 includes a molded movable contact assembly 62. The lower (with respect to FIGS. 4-7) end of the molded movable contact assembly 62 carries a slotted washer 64, a cup washer 66, and a shim and flat washer 68. A first compression spring 70 is disposed between the shim and flat washer 68 and a lower (with respect to FIGS. 4-7) surface 72 of the molded movable contact assembly 62. A second compression spring 74 is disposed between an upper (with respect to FIGS. 4-7) surface 76 of the molded movable contact assembly 62 and a surface 77 of the base 18. The first compression spring 70 provides a closing force and the second compression spring 74 provides an opening force.

In the open position of FIGS. 6 and 7, the device 2 has the movable contact member 44 separated from the fixed contacts 46 by an arc gap 78 (shown in FIG. 6).

Figure 8:
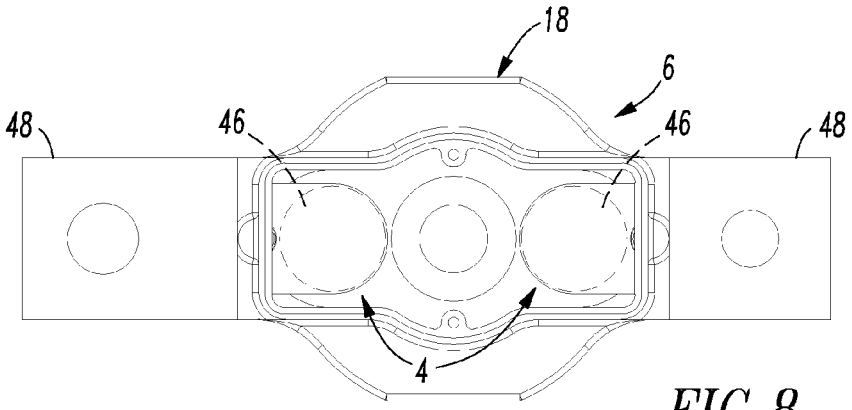
FIG. 8 is a bottom plan view of a base, two fixed contacts and associated conductors in accordance with another embodiment of the disclosed concept.
Figure 9:
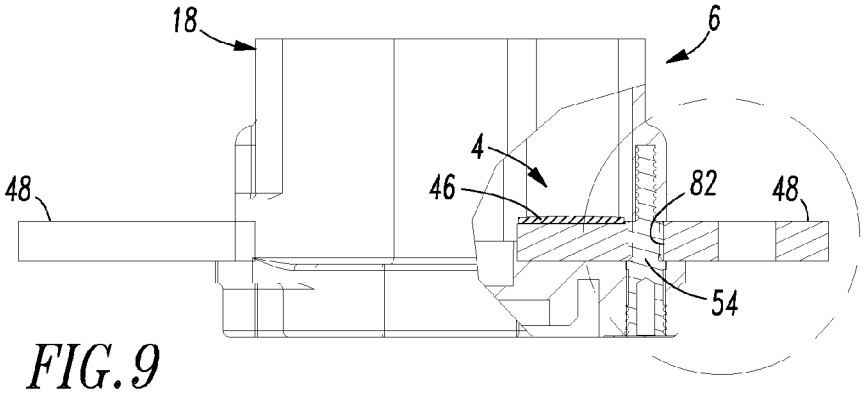
FIG. 9 is a vertical elevation view of the base and associated conductors of FIG. 8 with a portion shown in a cross sectional view to show one of the fixed contacts.
Figure 10:
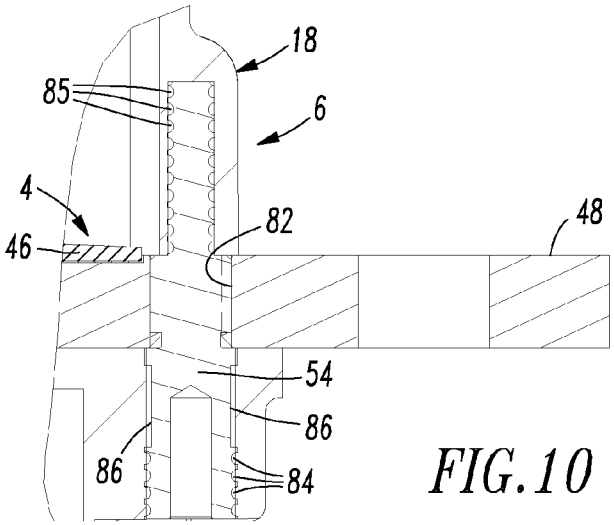
FIG. 10 is a cross sectional view of the portion of the base of FIG. 9.

FIGS. 8-10 show the base 18, the two fixed contacts 46 and the associated bus bars 48. The electrical current carrying path flows through one of the bus bars 48, through the corresponding one of the fixed contacts 46, through the movable contact member 44 and its movable contacts 45, through the other corresponding one of the fixed contacts 46, and through the other corresponding one of the bus bars 48. The thermally dissipating component set 6 (FIGS. 4-7) functions to remove heat from the electrical current carrying path. This heat is significantly reduced along the electrical current carrying path, as a function of the temperatures of the fixed contacts 46, movable contacts 45, movable contact member 44 and bus bars 48. The resistivity of the corresponding conductive material (e.g., copper) increases with temperature. By exchanging the heat or reducing the maximum temperature, the amount of heat (watts) is reduced. For example and without limitation, the voltage drop across the thermally managed electromagnetic switching device 2 is reduced by about 30% when made with a thermally conductive polymer, which remains an electrical insulator. This results in a reduction of about 50° C. across the device 2.

The thermally conductive polymer dissipates thermal energy over a relatively greater surface area, away from the current carrying component set 4, and to other areas of the electromagnetic switching device 2 where airflow may be present. This includes surface areas available to free air and eliminates an "oven" effect, which can trap heat with a plastic insulator. If the thermal path is un-interrupted, then transferring heat to free air is readily achieved. For example, in the disclosed concept, the thermal path for the current carrying component set 4 is from the fixed contacts 46 and the bus bars 48, through the base 18, to the annular groove 58, to the coil shell assembly 56, and to the top (with respect to FIGS. 3-7) of the cover 20. The example thermal path for the electromagnetic actuator 10 (coil 40) is from the coil 40, to the coil shell assembly 56, and to the top (with respect to FIGS. 3-7) of the cover 20.

The thermally dissipating component set 6 is made from, at least in part, a thermally conductive polymer, such as a thermally conductive grade Liquid Crystalline Polymer (LCP). A non-limiting example polymer is CoolPoly® D5506 Thermally Conductive Liquid Crystalline Polymer marketed as Cool Polymers® by Cool Options, Inc. of Warwick, R.I. This example LCP has a thermal conductivity of 10.0 W/m-K (69.4 BTU-in/hr-ft$^2$-° F.).

The two example bus bars 48 (e.g., made of copper), which include the two example fixed contacts 46, are mechanically interlocked and/or chemically bonded to the base 18 of the thermally dissipating component set 6. Each of the two example inserts 54 is coupled to a corresponding one of the two bus bars 48 at opening 82. The two bus bars 48 with the fixed contacts 46 are loaded into a plastic injection mold (not shown). The thermally conductive polymer flows into grooves 84,85 of the inserts 54 during the molding process. The thermally conductive polymer is molded around the fixed contacts 46 and the inserts 54 provide a mechanical interlock since the molding material flows into the grooves 84,85 and undercuts 86. The thermally conductive polymer transfers heat away from the current carrying component set 4 in the closed state of the device 2 to dissipate thermal energy.

Figure 11:
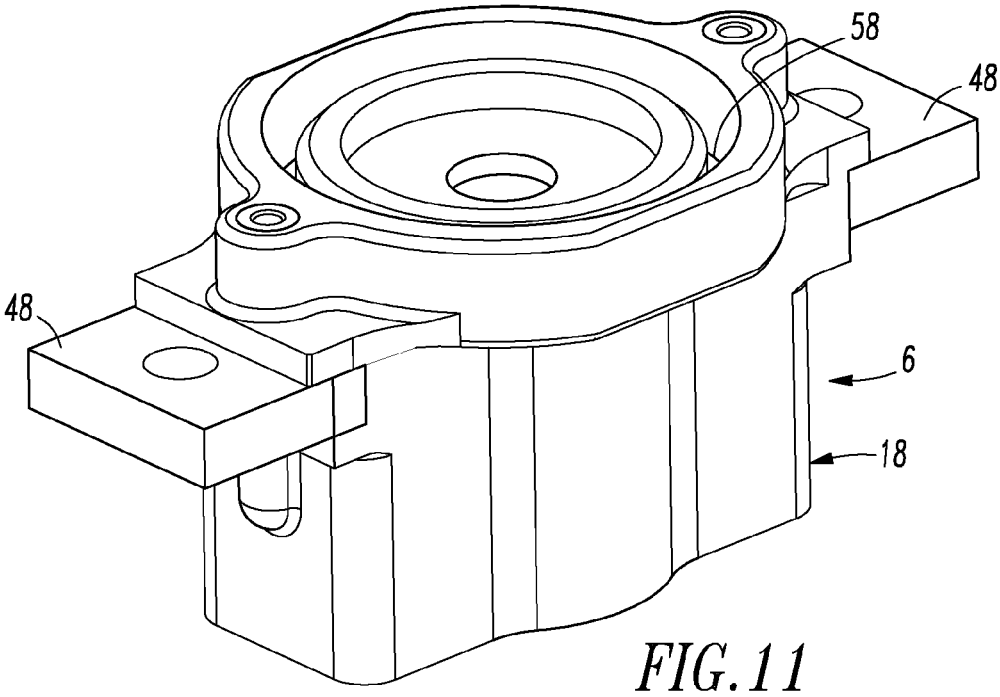
FIG. 11 is an isometric view of the base of the relay of FIG. 3.
Figure 12:
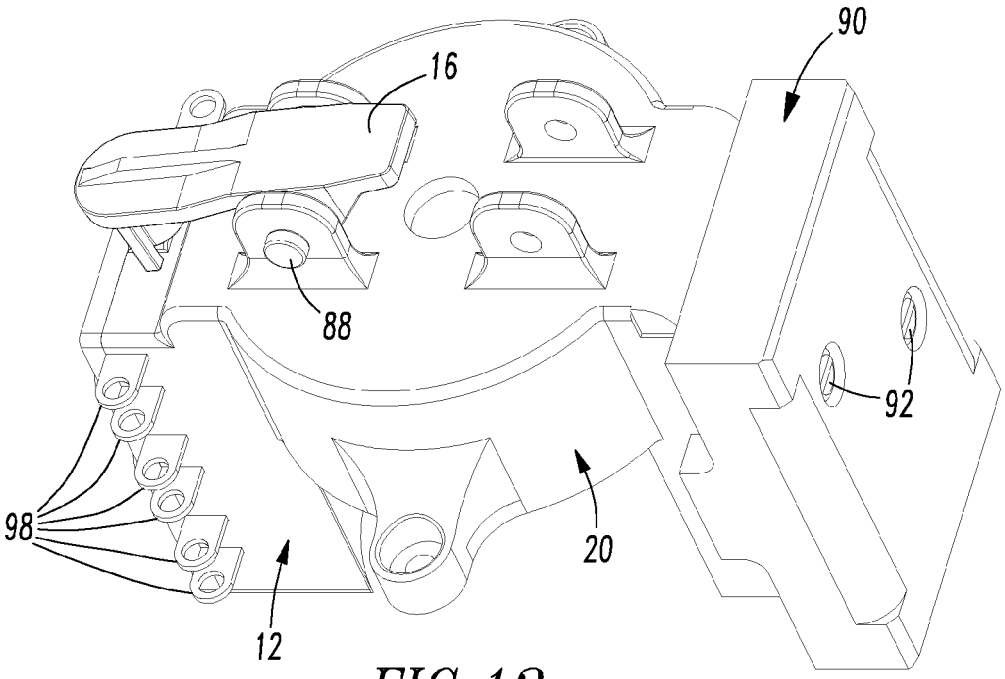
FIG. 12 is an isometric view of the cover of the relay of FIG. 3.

Referring to FIGS. 11 and 12, the base 6 and the cover 20, respectively, are shown. In this example, the cover 20 carries the auxiliary switch housing 12 and the number of rocker arms 16 is a single rocker arm 16, which pivots on a bearing roller pin 88. A separate housing 90 overmolds an "economizer" circuit (not shown), which functions to control the coil 40 (FIGS. 4-7). The housing 90 is secured to the cover 20 by fasteners 92 (e.g., without limitation, screws and helical washers). The "economizer" circuit is a conventional control circuit that allows for a relatively much greater magnetic field in an electrical switching apparatus during, for instance, the initial (e.g., without limitation, 50 mS) time following application of power to ensure that the plunger 42 (FIGS. 4-7) completes it travel and overcomes its own inertia, friction and spring forces. This is achieved by using a dual coil arrangement (not shown) in which there is a suitable relatively low resistance circuit or coil and a suitable relatively high resistance circuit or coil in series therewith. Initially, the economizer circuit allows current to flow through the low resistance circuit, but after a suitable time period, the economizer circuit turns off the low resistance path. This approach reduces the amount of power consumed during static states (e.g., relatively long periods of being energized).

Figure 13:
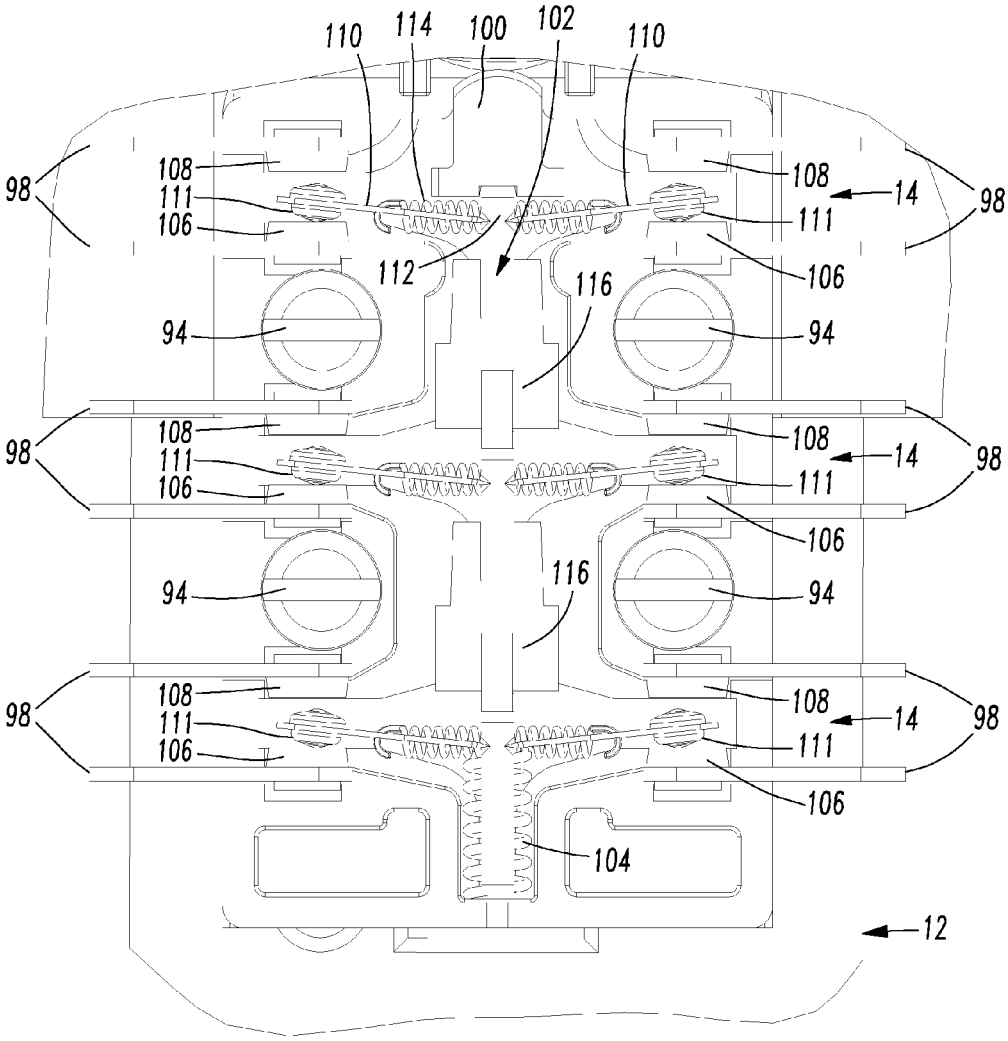
FIG. 13 is a vertical elevation view of the auxiliary switches of the relay of FIG. 3.

FIG. 13 shows the auxiliary switches 14 which, in this example configuration, include three sets of double break auxiliary switches 14. The housing 12 is secured to the cover 20 (FIG. 12) by four fasteners 94 (e.g., without limitation, screws and helical washers). A cover 96 (shown in FIG. 3) covers the auxiliary switches 14. Twelve contact terminal assemblies 98 define the three example sets of double break auxiliary switches 14, each of which includes two normally open and two normally closed terminals. Whenever the plunger 42 of FIGS. 4 and 5 is moved up (with respect to FIG. 4), the rocker arm 16 is pivoted (counterclockwise with respect to FIG. 5) to the position shown in FIG. 5, where it engages and presses downward (with respect to FIGS. 5 and 13) a button switch 100. A button switch shaft 102 then moves downward (with respect to FIG. 13), compresses compression spring 104 and closes three sets of normally open contacts 106. Otherwise, in the normally upward position (not shown), the three sets of normally closed contacts 108 are closed. It will be appreciated that the normally open contacts 106 and the normally closed contacts 108 can be reversed depending upon the normal state of the coil 40 and the main contacts 45,46.

Each of the auxiliary switches 14 includes a blade contact assembly 110 having two contact ends 111, a spring guide 112 and an extension spring 114, which passes behind (with respect to FIG. 13) the shaft 102. The two upper (with respect to FIG. 13) auxiliary switches 14 include a connector 116. The two contact ends 111 are electrically connected through the blade contact assembly 110, which has a pass through square opening to permit clearance for the shaft 102.

Unlike known prior electromagnetic switching devices that electrically isolate current carrying components with thermally insulating components, such as plastics, epoxies, sealants and potting materials, the disclosed concept electrically isolates and dissipates the thermal load with relatively fewer parts and relatively lower weight. For example, known relays and contactors include relatively hot components and relatively cool components. As a result, the cover and base of such relays and contactors have hot spots. By replacing the cover and base with a thermally conductive polymer, the entire housing thermally saturates. The temperature is transferred from heat sources, such as the contacts 45,46 and coil 40, to other components until the thermally conductive parts are stabilized or "saturated". Saturation is common in applications with no airflow. Saturation can also occur when the temperature of the device is equivalent to the surrounding environment temperature. In this case, thermal transfer is not physically possible, unless forced air is introduced. The disclosed concept provides a vast improvement in heat exchange in both free air and forced air environments.

Among other features, the electromagnetic switching device 2 of the disclosed concept exhibits improved reliability since heat is significantly reduced along the electrical current carrying path. Due to its heat dissipating properties, the electromagnetic switching device 2 of the disclosed concept allows for increased current carrying capability compared to known prior devices without adding size (e.g., without limitation, size of the bus bars 48; size of the fixed contacts 46, movable contacts 45 and movable contact member 44; size (and force) of the coil 40) and weight to current carrying components (e.g., fixed contacts 46, movable contacts 45, movable contact member 44, bus bars 48 and coil 40). In a particular example, non-limiting modeling of the disclosed concept, the temperature proximate the fixed contacts 46 was reduced by approximately 70° C. as compared to known prior devices, allowing the current carrying capacity of the electromagnetic switching device 2 to be increased from 400 A to 500 A without a corresponding increase in the size or weight of the current carrying component set 4.

Due to the heat dissipating properties of the thermally dissipating electromagnetic switching device 2, heat transfer from the coil 40 to adjacent thermally dissipating components, such as the cover 32 and the base 18, improves the coil strength by managing coil temperature (i.e., managing winding resistance via temperature). This feature improves response times for associated mechanical movement within the electromagnetic switching device 2.

The electromagnetic switching device 2 of the disclosed concept also allows for a reduction in aircraft wiring size (not shown) by reducing overall device temperature rise. The aircraft wiring sizing can be selected to maintain a predetermined electrical system temperature rise. A reduction in voltage drop across the fixed contacts 46, the movable contacts 45 and the movable contact member 44 is also facilitated by the disclosed concept since limiting the temperature rise lowers the resistance.

Due to its heat dissipating properties, the electromagnetic switching device 2 of the disclosed concept reduces the risk of reaching contact softening temperatures. Employing the base 18 and the cover 32 made of the example thermally conductive LCP allows transfer of heat from the coil 40, and from the fixed contacts 46 and movable contacts 45.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A thermally managed electromagnetic switching device comprising:

a current carrying component set switchable between a closed, current carrying state and an open, current interrupting state; and a thermally dissipating component set that functionally supports and electrically isolates said current carrying component set in said open state, said thermally dissipating component set comprising a thermally conductive polymer and being cooperatively structured to transfer heat away from said current carrying component set in said closed state to dissipate thermal energy, wherein said thermally dissipating component set comprises a base and a cover coupled to said base; wherein said cover and said base are made of the thermally conductive polymer; wherein said current carrying component set comprises a pair of electrically conductive fixed contacts carried by a pair of bus bars; and wherein said pair of bus bars are mechanically interlocked or chemically bonded to the thermally conductive polymer of said base.

2. The thermally managed electromagnetic switching device of claim 1 wherein said current carrying component set comprises a movable contact member fixedly coupled to a plunger for movement therewith; and wherein each electrically conductive fixed contact of said pair of electrically conductive fixed contacts is electrically isolated when the current carrying component set is in said open state, and is electrically connected in said closed state by movement of the movable contact member into contact with said pair of electrically conductive fixed contacts.

3. The thermally managed electromagnetic switching device of claim 2 wherein said thermally dissipating component set comprises the base within which said pair of electrically conductive fixed contacts is coupled; wherein said movable contact member and said pair of electrically conductive fixed contacts define an interface therebetween in said closed state; and wherein said base and said cover enclose said movable contact member and said interface.

4. The thermally managed electromagnetic switching device of claim 1 wherein said thermally conductive polymer is a thermally conductive grade liquid crystalline polymer.

5. The thermally managed electromagnetic switching device of claim 1 wherein said thermally dissipating component set is structured to transfer heat away from said current carrying component set in said closed state to dissipate thermal energy away from said current carrying component set, and to another area of said electromagnetic switching device.

6. The thermally managed electromagnetic switching device of claim 1 wherein said thermally managed electromagnetic switching device is selected from the group consisting of a relay and a contactor.

7. The thermally managed electromagnetic switching device of claim 1 wherein each of said bus bars includes an insert mechanically interlocked or chemically bonded to the thermally conductive polymer of said base; wherein said cover includes a pair of fasteners; and wherein each of said fasteners is coupled to the insert of a corresponding one of said bus bars.

8. A thermally managed electromagnetic switching device comprising:

a current carrying component set switchable between a closed, current carrying state and an open, current interrupting state;

an operating mechanism structured to move said current carrying component set between the closed, current carrying state and the open, current interrupting state; and a thermally dissipating component set that functionally supports and electrically isolates said current carrying component set in said open state, said thermally dissipating component set comprising a thermally conductive polymer and being cooperatively structured to transfer heat away from said current carrying component set in said closed state to dissipate thermal energy, wherein said thermally dissipating component set comprises a base and a cover coupled to said base; wherein said cover and said base are made of the thermally conductive polymer; wherein said current carrying component set comprises a pair of electrically conductive fixed contacts carried by a pair of bus bars; and wherein said pair of bus bars are mechanically interlocked or chemically bonded to the thermally conductive polymer of said base.

9. The thermally managed electromagnetic switching device of claim 8 wherein said operating mechanism comprises an electromagnetic actuator having a plunger and an electromagnetic coil that induces movement of the plunger in the presence of an electric current; wherein said current carrying component set comprises a movable contact member fixedly coupled to the plunger for movement therewith; and wherein each electrically conductive fixed contact of said pair of electrically conductive fixed contacts is electrically isolated when the current carrying component set is in said open state, and is electrically connected in said closed state by movement of the movable contact member into contact with said pair of electrically conductive fixed contacts.

10. A thermally managed electromagnetic switching device comprising:

a current carrying component set switchable between a closed, current carrying state and an open, current interrupting state;

an electromagnetic actuator;

a thermally dissipating component set that functionally supports and electrically isolates said current carrying component set in said open state, said thermally dissipating component set comprising a thermally conductive polymer and being cooperatively structured to transfer heat away from said current carrying component set in said closed state to dissipate thermal energy;

a switch housing;

a number of auxiliary switches; and a number of rocker arms actuated by said electromagnetic actuator, wherein said number of auxiliary switches is actuated by said electromagnetic actuator through said number of rocker arms;

wherein said thermally dissipating component set comprises a base and a cover coupled to said base; wherein said cover and said base are made of the thermally conductive polymer; wherein said current carrying component set comprises a pair of electrically conductive fixed contacts carried by a pair of bus bars; and wherein said pair of bus bars are mechanically interlocked or chemically bonded to the thermally conductive polymer of said base.

11. The thermally managed electromagnetic switching device of claim 10 wherein said electromagnetic actuator comprises a plunger and an electromagnetic coil that induces movement of the plunger; and wherein the plunger actuates said number of rocker arms in said closed state.

12. The thermally managed electromagnetic switching device of claim 10 wherein said number of auxiliary switches is a pair of double break auxiliary switches.

13. The thermally managed electromagnetic switching device of claim 10 wherein said current carrying component set further comprises an electromagnetic actuator having a movable contact member fixedly coupled to the plunger for movement therewith; and wherein each electrically conductive fixed contact of said pair of electrically conductive fixed contacts is electrically isolated when the current carrying component set is in said open state, and is electrically connected in said closed state by movement of the movable contact member into contact with said pair of electrically conductive fixed contacts.

14. The thermally managed electromagnetic switching device of claim 13 wherein said thermally dissipating component set comprises the base within which said pair of electrically conductive fixed contacts is coupled; wherein said movable contact member and said pair of electrically conductive fixed contacts define an interface therebetween in said closed state; and wherein said base and said cover enclose said movable contact member and said interface.

15. The thermally managed electromagnetic switching device of claim 10 wherein said thermally dissipating component set is structured to transfer heat away from said current carrying component set in said closed state to dissipate thermal energy away from said current carrying component set, and to another area of said electromagnetic switching device.

* * * * *